US005447039A

United States Patent [19]

Allison

[11] Patent Number: 5,447,039

[45] Date of Patent: Sep. 5, 1995

[54] BEVERAGE CAN COOLING SYSTEM

[76] Inventor: Robert S. Allison, 203 B Lentz Rd., Yulee, Fla. 32097

[21] Appl. No.: 219,490

[22] Filed: Mar. 29, 1994

[51] Int. Cl.[6] ..... F25D 3/10

[52] U.S. Cl. ..... 62/293; 62/294; 62/371; 62/457.9; 220/277

[58] Field of Search ..... 62/293, 294, 371, 457.1, 62/457.9, 457.4; 220/269, 272, 278, 277, 906

[56] References Cited

U.S. PATENT DOCUMENTS

| | | | |
|---|---|---|---|
| 2,642,203 | 6/1953 | Seemuller | 220/277 |
| 2,773,358 | 12/1956 | Palmer | 62/92 |
| 2,900,808 | 8/1959 | Wang | 62/293 |
| 3,494,142 | 2/1970 | Beck | 62/294 |
| 3,494,143 | 2/1970 | Barnett et al. | 62/294 |
| 3,553,976 | 1/1971 | Cumine et al. | 62/293 |
| 3,597,937 | 8/1971 | Parks | 62/294 |
| 3,759,060 | 9/1973 | Chase | 62/294 |
| 3,852,975 | 12/1974 | Beck | 62/294 |
| 3,881,321 | 5/1975 | Riley | 62/294 |
| 3,919,856 | 11/1975 | Beck | 62/60 |
| 4,669,273 | 6/1987 | Fischer et al. | 62/294 |
| 5,080,263 | 1/1992 | Johnson | 220/277 |

*Primary Examiner*—Henry Bennett
*Assistant Examiner*—William C. Doerrler
*Attorney, Agent, or Firm*—Arthur G. Yeager; Earl L. Tyner

[57] ABSTRACT

The present invention relates to the use of a pop top mechanism of a disposable beverage container which includes a lance in the pop top lever which can be pressed downwardly to penetrate the top of the container allowing a refrigerant inside the container to be released into the atmosphere thereby cooling the contents of the container by evaporation of the refrigerant coolant.

11 Claims, 4 Drawing Sheets

BEVERAGE CAN COOLING SYSTEM

BACKGROUND OF THE INVENTION

This invention relates in general to self-chilling disposable beverage containers that include a pressurized refrigerant that can be released at will to cool the beverage.

DESCRIPTION OF THE PRIOR ART

There exists voluminous prior art in the field of self-contained cooling devices that operate from the principle of releasing a refrigerant coolant, e.g., liquified carbon dioxide into the atmosphere from a pressurized vessel to have the effect of chilling the contents of a container. There also is prior art in this field that discloses a lance mechanism which punctures a self-contained pressure vessel inside a beverage container for the purpose of releasing a refrigerant gas. However, notwithstanding the precise merits, features and advantages of the above cited references, none of them achieves all of the requirements necessary for operation of a safe, reliable, efficient and inexpensive self-chilling, disposable liquid beverage container.

Most of the prior art necessitates the production of special containers which are so costly as to be impractical for the commercial market. There are exceptions to this statement, but the exceptions possess certain other specific shortcomings by either requiring modifications to the container lid assembly or by requiring additional tools to release the refrigerant gas to activate the cooling process.

Whatever the precise merits, features and advantages of the prior art systems, none of them provides a system which is adaptable to a substantially unmodified beverage can. Furthermore, none of the prior art systems has been sufficiently user-friendly to achieve any commercial acceptance in the consumer market.

Accordingly, it is a principal object of the present invention to provide an inexpensive system which should be readily acceptable for use by the disposable beverage container industry. It is another object of this invention to provide a self-chilling beverage container which is safer to handle, and has substantially no risk of accidental discharge. Still other new and advantageous aspects will become apparent in the more detailed description below.

BRIEF SUMMARY OF THE INVENTION

The present invention provides a system which is a combination of a disposable beverage can for liquids, and a discrete separate pressure vessel containing a refrigerant, which upon release into the atmosphere by pressing a lance into the pressure vessel results in a rapid chilling of the beverage.

The disposable beverage container itself is typical of the containers used for soft drinks, beer and the like, preferably constructed from aluminum or an aluminum alloy, although other metals are entirely suitable. The only difference in the beverage container is a slight modification to the pop top lever which opens the container. In the handle end of the lever which is operated by the finger of the user, there is a generally flat pointed lance which, in the unopened position rests in the same plane as the handle end of the pop top lever, but which can be folded downwardly so as to puncture the top of the beverage can and also puncture the reservoir of refrigerant inside the can when the handle is pushed downwardly.

By puncturing the reservoir of refrigerant in the pressure vessel, the refrigerant, preferably liquid carbon dioxide, is harmlessly exhausted into the atmosphere, and an accompanying cooling of the beverage in the can occurs.

The refrigerant pressure vessel of this invention fits closely inside the beverage can and is a thin shell made up of an elongated tube bent many times to form a cylindrical shell wall and connected at the top end to a small reservoir positioned so as to be punctured by operation of the lance described above on the pop top lever. The conduit and the reservoir are filled with a liquid refrigerant which is under pressure while in the conduit but which will spontaneously evaporate when that pressure is released. The wall of the shell is made up principally of a small tube with many reverse bends so as to allow short lengths of the tube to lie parallel and side-by-side with adjacent short lengths of the tube. The wall may be impervious to the beverage in the can, but preferably is porous so as to permit the beverage to flow freely through the wall. The tube making up the wall is impervious to the refrigerant and is generally one continuous tube from a closed end at the bottom of the can to the reservoir at the top of the can, which reservoir is eventually punctured by the lance in the pop top lever to release the pressure on the refrigerant which results in cooling the contents of the can.

In the preferred embodiment of this invention it is intended that the metal materials used for fabrication of the pop top lever driven lance and the cooperating self-contained refrigerant pressure vessel be of identical materials as the beverage container itself to facilitate efficient recycling of the entire spent container.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

This invention relates to a two-piece self-cooling beverage container. One of the two separate and distinct pieces is a beverage can with a pop top opener, the only novel portion of which is the pop top opener, the remainder of the beverage container being well-known prior art. The second of the two separate and distinct pieces is a thin hollow cylindrical shell which contains a pressurized refrigerant in a serpentine conduit extending throughout all portions of the shell. These two pieces are manufactured separately. The shell is slid into the can before the can is filled with beverage and closed. Thus, the entire self-cooling container does not require redesigning the beverage can, its lids, or the machines for making the can; although it does require the incorporation of a novel pop top lever on the upper lid. This invention does require the manufacture of a thin shell containing pressurized refrigerant, and a step of sliding this shell into the can before beverage is placed in the can. The shell is shaped such that it will slide into the can readily and will be automatically positioned for use regardless of which end of the shell is slid first into the can.

Figure 5:
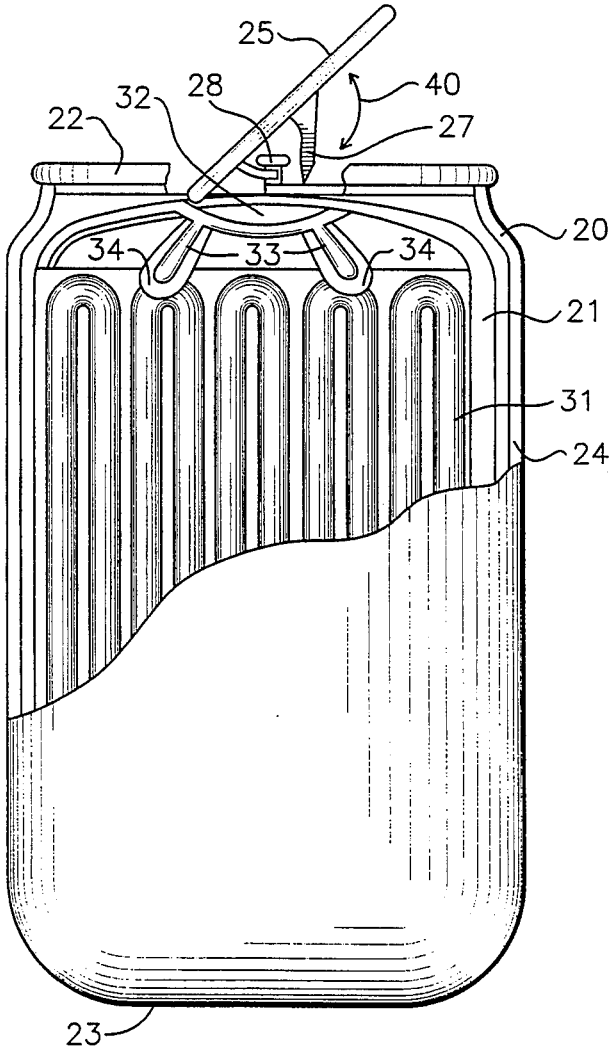
FIG. 5 is a fragmentary cross-sectional view of the beverage container with the pop top in the open container position and the lance positioned to puncture the pressure vessel reservoir.

Referring to the figures of the drawings there is shown in FIGS. 1–5 beverage container 20 of this invention. Top wall 22 of container 20 is the crimp-joined to the top of cylindrical side wall 24 and is scored to provide a tear out section 43 of the top of the container which opens the container for access to the contents. Section 43 is pushed toward the interior of the container by lifting ring 44 of the pop top lever 25. The typical fastening device between the top of the container and the pop top lever is a rivet connection 28. The hinging characteristic between the pop top lever 25 and the connecting rivet 28 is facilitated by bending the metal surrounding the connecting rivet 28. This is made easier by including a slot 45 in the pop top lever 25. One of the important features of the pop top mechanism 25 of this invention is that a pointed lance 26 is formed in the pop top lever 25 resting in the same horizontal plane as the balance of the pop top lever 25. In this position, it is impossible for the pointed end of the lance 26 to cause personal injury during the opening process, and it also is impossible for it to cause either an accidental discharge of the beverage container 20 or self-contained pressure vessel 21. In the unused container this protected location allows all normal handling, stacking, and packaging of the beverage container to occur without concern for injury. This pointed lance is, in the preferred embodiment, reinforced on its underside and along its edges by a doubling over of the excess metal along its edges. Lifting ring 44 of pop top lever 25 positions (see FIG. 5) the pointed lance to be bent downward into puncture position 27 as seen in FIG. 5. Downward manual pressure can then be used to push the lance through the top surface 22 of container 20. As shown a small depression 48 may be pre-formed in top surface 22 to act as a receiving seat for the point of lance 27 to facilitate the puncturing Operation, if desired. The location of the rivet 28 is important to allow leverage to magnify the pressure against the scored section 43 and also to drive the pointed lance through the top surface of the container. The pointed end of the lance 26 passes through top surface 22 of container 20 and on through a penetrable surface of a refrigerant reservoir 32 in the cooling shell 21 immediately below top surface 22. This step creates an escape route into the atmosphere for the pressurized refrigerant which is contained in cooling shell 21. The shell 21 is inside the beverage container in a position such that reservoir 32 with a penetrable surface presses firmly against the underside of top surface 22. By puncturing a hole in the refrigerant container the pressurized liquid or gas is allowed to evaporate and/or escape into the atmosphere thereby rapidly chilling the wall surfaces of the cooling shell 21 which, in turn, chills the enclosed beverage. In the preferred embodiment this refrigerant is liquid carbon dioxide. As shown in FIGS. 3–5 and 7 the preferred embodiment of cooling shell 21 is a hollow cylindrical structure which has an outside diameter only marginally smaller than the inside diameter of the container itself. The length of this cylinder is ideally just marginally shorter than the distance between the inside top surface and inside bottom surface of the beverage container in which it is contained. By fabricating the pressure vessel to these ideal dimensions contact between the vessel and interior walls and bottom and top surfaces of the beverage container serves to position the penetrable reservoir 32 at the proper location against the inside of top wall 22 of container 20 and directly under the place that will be punctured by the pointed lance 26.

Figure 3:
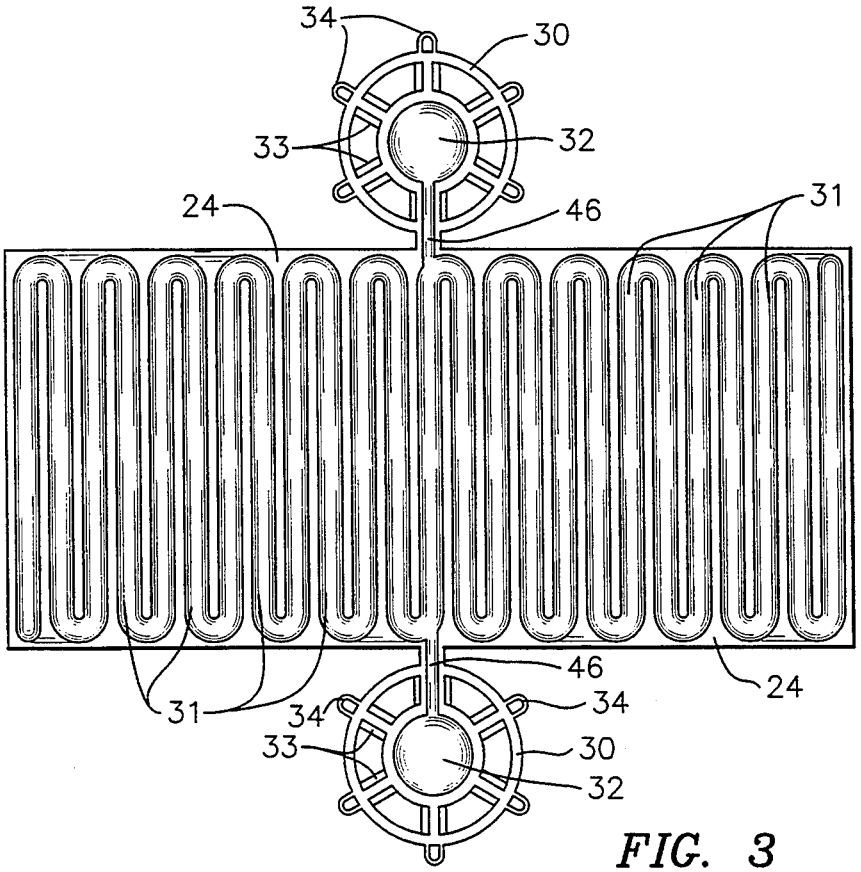
FIG. 3 is a top plan view of the outside of the pressure vessel in the form of a blank prior to being formed into a hollow cylindrical shape.
Figure 4:
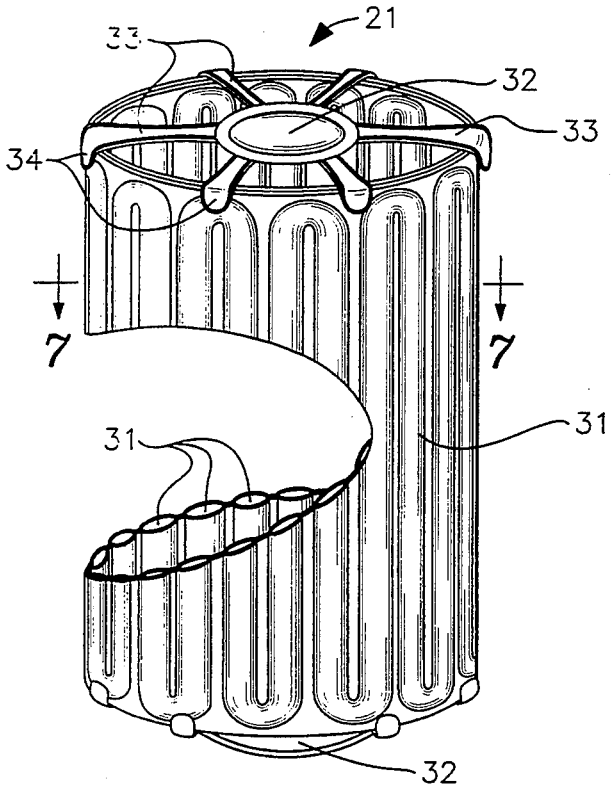
FIG. 4 is a cutaway perspective view of the charged pressure vessel envelop of FIG. 3 formed to a hollow cylindrical shape.

In FIG. 3 there is shown a flat blank of the side wall 29 at cooling shell 21. Preferably cooling shell 21 is constructed from two essentially identical pieces of stamped and formed sheet metal heat welded or soldered together to form a conduit extending throughout the entire wall 29. A plurality of reverse bends will allow the conduit to extend to all locations in wall 29. Fins may be included to facilitate heat transfer. The structure will be welded or soldered together to make a long serpentine gas chamber 31 to provide a lengthy escape route for the evaporating refrigerant gas so as to maximize the cooling effect. This particular configuration also maximizes the surface area of the vessel in contact with the escaping gas thereby decreasing the amount of gas required to chill a beverage to ideal temperatures. The cooling shell 21, as manufactured, will be a flat structure as shown in FIG. 3 which can then be rolled into a tubular cylindrical shape with the identical top and bottom walls 30 folded to form a cap at each end as in FIG. 4. The spokes 33 will provide structural reinforcement when each spoke tip 34 is welded or soldered to wall 24. The result is a thin-walled structure positioned closely adjacent to the walls of container 20 and containing a continuous conduit extending from top 21 to bottom 21, symmetrical about a plane laterally through the geometric center of the structure. Since there is a reservoir 32 in each top 30 and bottom 30, the cooling shell 21 can be introduced into can 20 in either of the two possible orientations and be operable to function with lance 26 able to puncture a reservoir and release compressed gas to the atmosphere.

The maximum cooling effect from a specific measure of evaporating liquified carbon dioxide is obtained by controlling the flow rate of the released carbon dioxide gas. In the preferred embodiment an orifice controlling the flow rate of the released gas is formed into the serpentine chamber of the shell at channel 46. It is also noted that there may be some embodiments, e.g., when employing a pressurized gas rather than an evaporating liquid for the refrigerant, which would operate more efficiently by positioning the orifice deeply within shell 21 rather than at the top wall 22 of can 20. It is within the skill of the art to position the orifice for optimum cooling.

Figure 6:
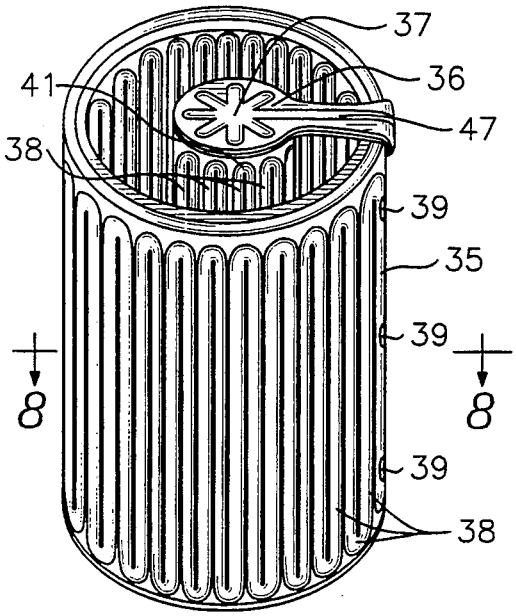
FIG. 6 is a second embodiment of the charged pressure vessel envelope showing the walls vertically supporting the penetrable reservoir.
Figure 7:
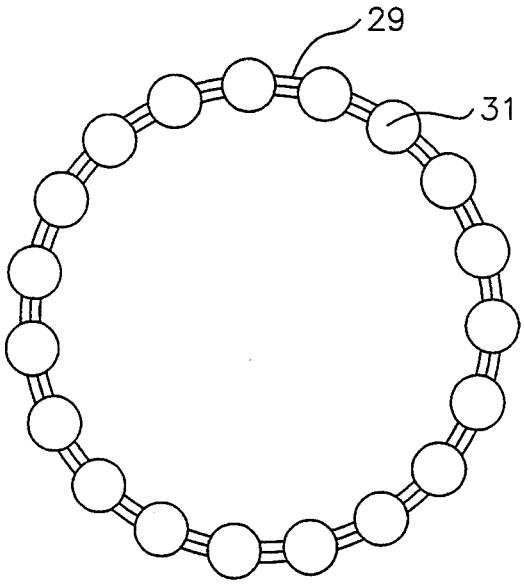
FIG. 7 is a cross-sectional view taken at 7—7 of FIG. 4.
Figure 8:
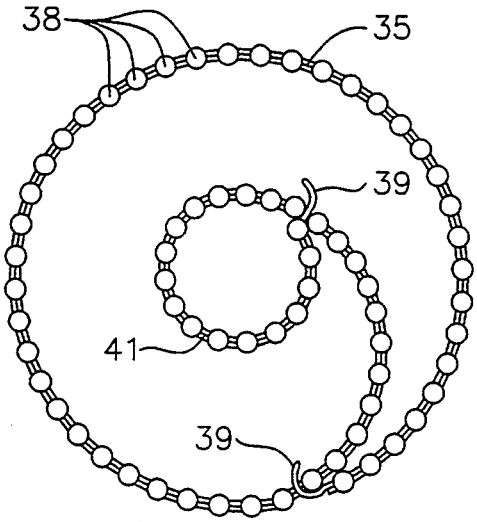
FIG. 8 is a cross-sectional view taken at 8—8 of FIG. 6.
Figure 9:
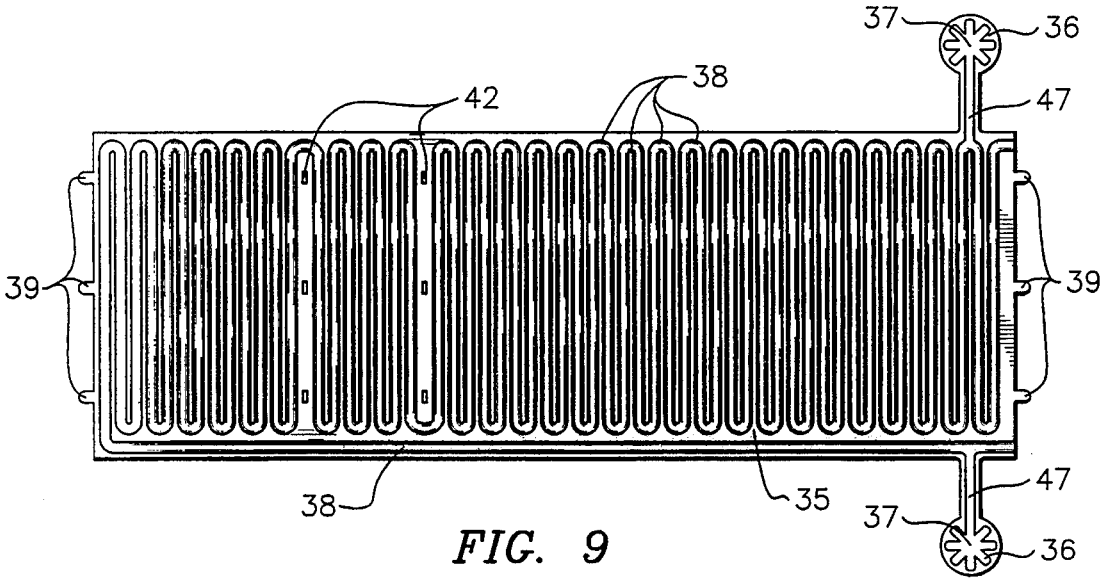
FIG. 9 is a top plan view of the outside of the pressure vessel shown in FIG. 6 flattened into a blank before assembly into a hollow cylindrical shape.

In FIGS. 6, 8 and 9 there is shown a second embodiment of cooling shell 21 which utilizes its particular transfiguration to provide vertical support for the penetrable reservoir 37 and for insuring its contact with the inside of the top wall 22 of beverage container 20. This particular shell is formed with folding tabs 39 on two ends and voids 42 in the side wall structure 38 to receive tabs 39 to form a hollow cylindrical structure (see FIG. 6). These tabs 39 are used to secure the wall 35 into two concentric cylinders, the inside one being 41 and the outside one being 35 in FIG. 8. This particular design increases the surface area of the vessel to provide better heat transfer with the surrounding beverage, and also to allow cylinder 41 to support reservoir 37 in its proper location. Because its serpentine conduits are fabricated to inflate into smaller diameters than the shell of FIGS. 4 and 5, the shell of FIGS. 6, 8 and 9 can be fabricated from lighter gauge materials. The penetrable surface areas on the top and bottom of this second embodiment may provide a smaller reservoir 37, or one as large as reservoir 32 of the first embodiment, so long as a sufficient metal thickness remains to contain the pressure of the refrigerant. The star configuration of reservoir 37 is particularly useful in positioning one or more of the channels to be at or near right angles to the flat cutting edge of the pop top driven lance 26 and to insure that lance 26 will puncture enough to release the pressure of the refrigerant to provide the cooling effect.

Figure 1:
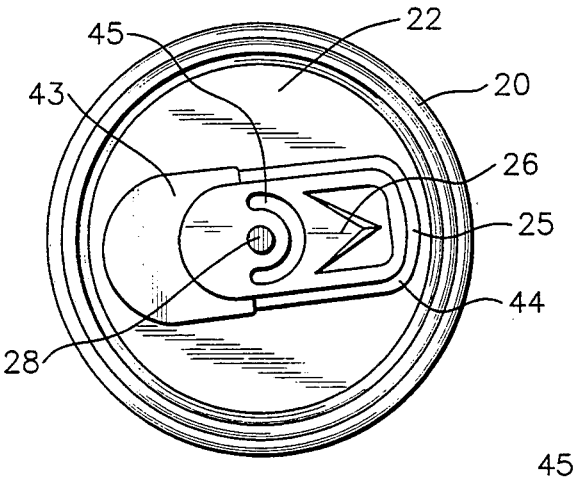
FIG. 1 is a top plan view of the beverage can of this invention.
Figure 2:
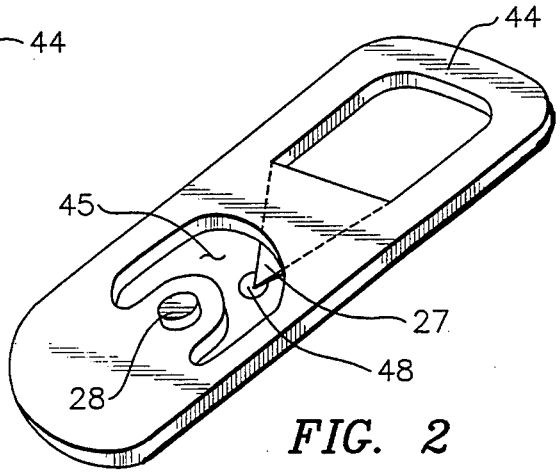
FIG. 2 is a perspective view of the pop top mechanism and pointed lance of this invention.
Figure 10:
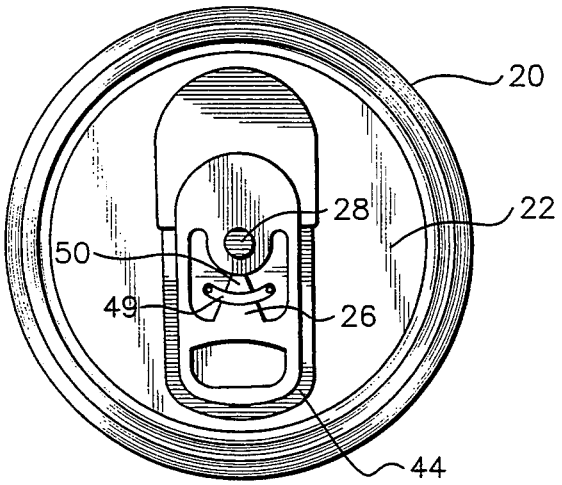
FIG. 10 is a top plan view of a second embodiment of a beverage can pop top mechanism.

FIG. 10 shows a second embodiment of the pop top mechanism of FIGS. 1–2. In this embodiment the lance 26 is automatically bent to its puncture position upon lifting of ring 44 to open the beverage can 20. In this embodiment the tip 50 of lance 26 faces toward rivet 28 rather than toward ring 44. The tip 50 of lance 26 is restrained against the top wall 22 of beverage can 20 by a strip 49 riveted or otherwise fastened at each end to top wall 22. As ring 44 is lifted, lance 26 is lifted with tip 50 held against top wall 22 until tip 50 is released from strip 49. In so doing lance 26 is bent downward with tip 50 facing wall 22. A downward push on ring 44 will cause tip 50 to puncture wall 22.

Figure 11:
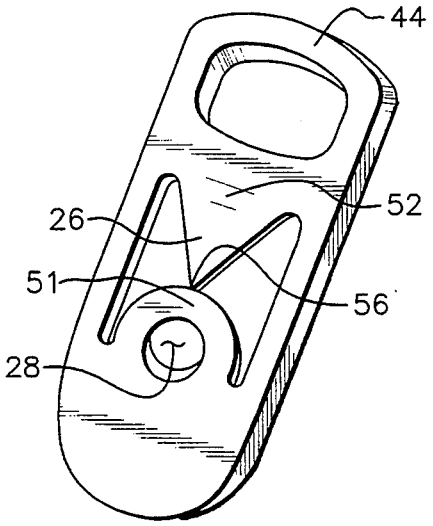
FIG. 11 is a perspective view of a third embodiment of the beverage can pop top mechanism.

FIG. 11 shows a third embodiment to the pop top mechanism. In this embodiment lance 26 is oriented with tip 50 pointed toward rivet 28 as in FIG. 10. Here tip 50 is retained under shoulder 51, which is a seat for rivet 28. As described above, when ring 44 is lifted to open the beverage can, lance 26 will be bent about fold lines 52 until tip 50 is released from shoulder 51 and is pointing downward toward top wall 22. Pushing downward on ring 22 will then puncture end wall 22 and interior reservoir 37 to release pressurized refrigerant to cool the can's contents. Still other designs may be imagined to cause lance 26 to be placed in puncturing position to effect a release of refrigerant to cool the can's contents. Any such arrangement is intended to be included within the scope of this invention.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by letters patent of the United States is:

1. A combination apparatus for self-cooling the contents of a beverage can which comprises a cylindrical metallic container having a top with a pop top lever opener, a bottom, a cylindrical side wall, and a hollow interior; said pop top lever including a pointed lance member which in its unused position lies in the general plane of the pop top lever and which is foldable downward to its use position adapted to puncture said top upon the application of manual pressure downwardly on said lever; a cylindrical shell structure separate from said beverage can, and slidable into said hollow interior close to said side wall inside said beverage can, said shell structure comprising a thin wall containing an elongated serpentine passageway terminating in a reservoir inside of said top at a position to be punctured by said pointed lance when puncturing said top; said passageway being filled by a refrigerant which absorbs heat from its surroundings upon being exposed to atmospheric pressure.

2. The apparatus of claim 1 wherein said shell structure is symmetrical about a lateral plane perpendicular to said thin wall and passing through the geometrical center of said shell structure.

3. The apparatus of claim 1 wherein said refrigerant is liquid carbon dioxide.

4. The apparatus of claim 1 wherein said shell structure has a top, a bottom, and a cylindrical side wall; said shell side wall comprising a plurality of generally parallel hollow tubes distributed substantially equally throughout said side wall of the shell structure and said top including a passageway for said refrigerant from said hollow tubes to said reservoir.

5. The apparatus of claim 1 wherein said shell structure is made of aluminum.

6. The combination of a cylindrical aluminum beverage can with a pop top lever opener, and a cylindrical aluminum shell which fits entirely within said can but without physical connection to said can; said can having a cylindrical side wall, a circular top wall and a circular bottom wall; all said walls being fastened to each other to make a container for beverages; said pop top lever opener having a finger operating lever which includes a pointed lance which, in its unused position, lies in the general plane of the opener, and which is foldable downwardly to direct said pointed lance at said top wall, and which is adapted to rupture said top wall when said lever with the downwardly directed lance is pushed downwardly; said shell having a side wall, a top wall, and a bottom wall, and having a size and shape which is concentric to said beverage can and spaced closely to said walls of said beverage can; said side wall of said shell comprising an elongated tubular conduit bent with a plurality of reverse bends to form said shell side wall, and said top wall of said shell including a small reservoir connected to a tubular conduit, which, in turn, is connected operationally to said conduit in said side wall of said shell, said conduit and said reservoir containing an evaporatable liquid refrigerant, said reservoir being positioned so as to be punctured by the downward movement of said pointed lance.

7. The combination of claim 6 where both said can and said shell are aluminum.

8. The combination of claim 6 wherein both said top wall and said bottom wall of said shell contain a reservoir for said refrigerant and a conduit to connect said reservoir with said conduit in said side wall of said shell.

9. The combination of claim 6 wherein said pointed lance is adapted to be folded downwardly by finger pressure of the user.

10. The combination of claim 6 wherein said pointed lance has a sharp tip that is automatically bent downward to direct said point at said top wall as said finger operated lever is bent upwards to open said beverage container.

11. The combination of claim 10 wherein said point is temporarily physically restrained from movement away from said top wall as said finger operated lever is bent upward, causing said pointed lance to bend downward until said point is relieved from its physical restraint.

* * * * *